US012522400B2

(12) United States Patent
Hinkle

(10) Patent No.: US 12,522,400 B2
(45) Date of Patent: Jan. 13, 2026

(54) LOAD CARRYING STRUCTURE

(71) Applicant: BOZEL NORTH AMERICA LLC, Temperance, MI (US)

(72) Inventor: Robert Hinkle, Lambertville, MI (US)

(73) Assignee: BOZEL NORTH AMERICA LLC, Temperance, MI (US)

( * ) Notice: Subject to any disclaimer, the term of this patent is extended or adjusted under 35 U.S.C. 154(b) by 50 days.

(21) Appl. No.: 18/311,666

(22) Filed: May 3, 2023

(65) Prior Publication Data

US 2023/0356880 A1 Nov. 9, 2023

Related U.S. Application Data

(60) Provisional application No. 63/338,486, filed on May 5, 2022.

(51) Int. Cl.
*B65D 19/00* (2006.01)

(52) U.S. Cl.
CPC ..... *B65D 19/0024* (2013.01); *B65D 19/0046* (2013.01); *B65D 2519/00059* (2013.01); *B65D 2519/00273* (2013.01); *B65D 2519/00288* (2013.01); *B65D 2519/00323* (2013.01); *B65D 2519/0098* (2013.01)

(58) Field of Classification Search
CPC ..... B65D 19/0024; B65D 19/0046; B65D 2519/00059; B65D 2519/00273; B65D 2519/00288; B65D 2519/00323; B65D 2519/0098
USPC ..... 108/51.11
See application file for complete search history.

(56) References Cited

U.S. PATENT DOCUMENTS 2,448,447 A * 8/1948 Lau ..... 108/51.11
3,301,200 A * 1/1967 Landsiedel ..... B65D 19/0097 108/56.1
3,469,542 A * 9/1969 Ahlenius ..... B65D 19/0071 108/56.1
3,651,769 A * 3/1972 Foley ..... B65D 19/0073 108/52.1
4,635,562 A * 1/1987 Kreeger ..... B65D 19/18 108/56.1

(Continued)

FOREIGN PATENT DOCUMENTS

IT 201800005707 A1 11/2019
WO WO 2018/183913 A1 10/2018

OTHER PUBLICATIONS

International Search Report and Written Opinion for PCT/US2023/066623 (ISA/EP) mailed Sep. 5, 2023 (14 pages).

*Primary Examiner* — Daniel J Troy
*Assistant Examiner* — Timothy M Ayres
(74) *Attorney, Agent, or Firm* — ALSTON & BIRD LLP

(57) ABSTRACT

An apparatus and method are described herein for a load carrying structure, and more particularly, to a load carrying pallet formed of modular interlocking components that do not require welding or bonding. An apparatus includes a load carrying structure having: a plurality of side members removably connected to each other to form a base; a first support member and a second support member, where the first support member and the second support member are each removably connected between a respective pair of the plurality of side members; and a top member, where the top member is removably fastened to each of the plurality of side members.

20 Claims, 10 Drawing Sheets

(56) References Cited

U.S. PATENT DOCUMENTS 4,979,446 A * 12/1990 Winebarger ..... B65D 19/0026 108/56.1
5,218,913 A * 6/1993 Winebarger ..... B65D 19/0028 108/56.1
5,295,445 A * 3/1994 Locke ..... B65D 19/0095 108/57.1
5,357,875 A * 10/1994 Winebarger ..... B65D 19/0024 108/51.3
5,447,107 A * 9/1995 Iwaoka ..... B65D 19/0012 52/798.1
5,461,988 A * 10/1995 Cummings ..... B65D 19/0075 108/56.1
5,487,345 A * 1/1996 Winebarger ..... B65D 19/0024 108/56.1
6,155,181 A 12/2000 Chilcutt
6,192,807 B1 * 2/2001 Mason ..... B65D 19/0002 108/51.11
6,234,086 B1 * 5/2001 Mason ..... B65D 19/38 108/51.11
6,892,651 B1 * 5/2005 Van Reed ..... B65D 19/0075 108/56.1
7,000,549 B2 * 2/2006 Nelson ..... B65D 19/0012 108/51.3
8,113,129 B1 * 2/2012 Hurley ..... B65D 19/0028 108/56.3
8,291,836 B2 * 10/2012 Jian ..... B65D 19/0028 108/51.3
8,316,780 B2 * 11/2012 Ng ..... B65D 19/18 108/56.1
8,424,468 B2 * 4/2013 Aden ..... B65D 19/0026 108/57.32
8,448,582 B2 * 5/2013 Jian ..... B65D 19/0097 108/901
8,814,110 B2 * 8/2014 Crager ..... B65D 19/0002 206/524.6
9,185,854 B2 * 11/2015 Galal ..... B65D 11/06
9,260,218 B2 * 2/2016 Lundius ..... B65D 19/0095
10,118,732 B2 * 11/2018 Segerstrom ..... B65D 19/0095
11,192,685 B2 * 12/2021 Park ..... B65D 19/0095
11,242,173 B2 * 2/2022 Rickabaugh ..... B65D 19/08
11,807,417 B1 * 11/2023 Green ..... B65D 19/0095
2004/0226490 A1 * 11/2004 Polumbaum ..... B65D 19/0093 108/56.1
2011/0203491 A1 * 8/2011 Poe ..... B65D 19/0097 108/57.32
2012/0000399 A1 1/2012 Aden et al.
2012/0125238 A1 * 5/2012 Johnson ..... B23P 15/00 108/57.32
2013/0213277 A1 8/2013 Linares

* cited by examiner

LOAD CARRYING STRUCTURE

CROSS-REFERENCE TO RELATED APPLICATIONS

This application claims priority to U.S. Provisional Application Ser. No. 63/338,486, filed on May 5, 2022, the contents of which are herein incorporated by reference in their entirety.

TECHNOLOGICAL FIELD

Embodiments of the present disclosure relate generally to load carrying structures, and, more particularly, to pallets formed of modular interlocking components.

BACKGROUND

Load carrying structures, such as pallets are used in a variety of applications to support items thereon, such as to support coils of wire for use in manufacturing, industrial applications, and/or the like. Pallets are often made from wood and are made to be disposable. However, reusable pallets can be more cost effective and durable. Reusable pallets can be made of composites, plastics, metal, or a combination thereof. Conventional pallet designs, however, are often formed of permanently joined (e.g., welded, glued, etc.) components as part of the manufacturing process. As such, transportation of these conventional pallets is cumbersome and expensive due to the rigid nature of these designs and the increased footprint occupied by these designs. Applicant has identified a number of deficiencies and problems associated with conventional pallet implementations. Through applied effort, ingenuity, and innovation, many of these identified problems have been solved by developing solutions that are included in embodiments of the present disclosure as described in detail herein.

BRIEF SUMMARY

Embodiments of the present disclosure address the above by providing pallet implementations formed of a plurality of interlocking components. Further, embodiments provide load carrying structures that do not require welding or bonding of parts in their construction. An example embodiment provided herein includes a load carrying structure that includes: a plurality of side members removably connected to each other to form a base; a first support member and a second support member, where the first support member and the second support member are each removably connected between a respective pair of the plurality of side members; and a top member, where the top member is removably fastened to each of the plurality of side members.

According to an example embodiment, each of the plurality of side members includes a pair of apertures defined therethrough for receiving forks of at least one of a forklift or a pallet jack. According to certain embodiments, the plurality of side members includes a first side member, a second side member, a third side member, and a fourth side member, where the plurality of side members are removably connected to form a quadrilateral-shaped base. According to some embodiments, each of the plurality of side members are identical.

The plurality of side members of an example embodiment each define a top side and a bottom side, where the plurality of side members are connected to each other using a tab and slot, where a respective tab is received within a respective slot and secured through a relatively downward movement of the tab toward the bottom side of a respective side member. The top member of an example embodiment, when fastened to the plurality of side members, precludes disengagement of the respective tab from the respective slot. The first support member and the second support member are, in some embodiments, removably connected to each other. According to some embodiments, the top member, when fastened to each of the plurality of side members, prevents disconnection between the plurality of side members, the first support member, and the second support member. The top member of an example embodiment defines a top surface, where the top surface includes at least one load stabilizing feature. The at least one stabilizing feature of an example embodiment includes a pair of opposing wedges configured to cradle a load therebetween.

Embodiments provided herein include a load carrying structure including: a first side member, a second side member, a third side member, and a fourth side member, where the first side member, the second side member, the third side member, and the fourth side member are connected to form a rectangular base; a first support member removably connected between the first side member and the third side member; a second support member removably connected between the second side member and the fourth side member; and a top member removably connected to the first side member, the second side member, the third side member, and the fourth side member, where the first side member, the second side member, the third side member, the fourth side member, the first support member, and the second support member are precluded from disconnecting from one another in response to the top member being connected to the first side member, the second side member, the third side member, and the fourth side member.

According to some embodiments, the first side member, the second side member, the third side member, and the fourth side member each include a pair of apertures defined therethrough for receiving forks of at least one of a forklift or a pallet jack. According to certain embodiments, the first side member, the second side member, the third side member, and the fourth side member are interchangeable. According to some embodiments, each of the first side member, the second side member, the third side member, the fourth side member, the first support member, and the second support member are formed of sheet metal. According to some embodiments, the first side member, the second side member, the third side member, and the fourth side member are releasably connected by complementary pairs of tabs and slots to form the rectangular base. The top member of some embodiments defines a top surface, where the top surface includes at least one load stabilizing feature. According to some embodiments, the at least one load stabilizing feature includes a pair of opposing wedges configured to cradle a load therebetween.

Embodiments provided herein include a method for constructing a load carrying structure including: interconnecting a first side member, a second side member, a third side member, and a fourth side member to form a rectangular base; connecting a first support member between the first side member and the third side member; connecting a second support member between the second side member and the fourth side member; and connecting a top member to the first side member, the second side member, the third side member, and the fourth side member, where the first side member, the second side member, the third side member, the fourth side member, the first support member, and the second support member are locked together by the top member. According to some embodiments, connecting the top member to the first side member, the second side member, the third side member, and the fourth side member includes fastening the top member to the first side member, the second side member, the third side member, and the fourth side member using a plurality of threaded fasteners. According to some embodiments, interconnecting the first side member, the second side member, the third side member, and the fourth side member to form the rectangular base includes joining tabs and slots of respective side members at each corner of the rectangular base.

BRIEF DESCRIPTION OF THE DRAWINGS

Having described certain example embodiments of the present disclosure in general terms above, reference will now be made to the accompanying drawings. The components illustrated in the figures may or may not be present in certain embodiments described herein. Some embodiments may include fewer (or more) components than those shown in the figures.

DETAILED DESCRIPTION

Figure 1:
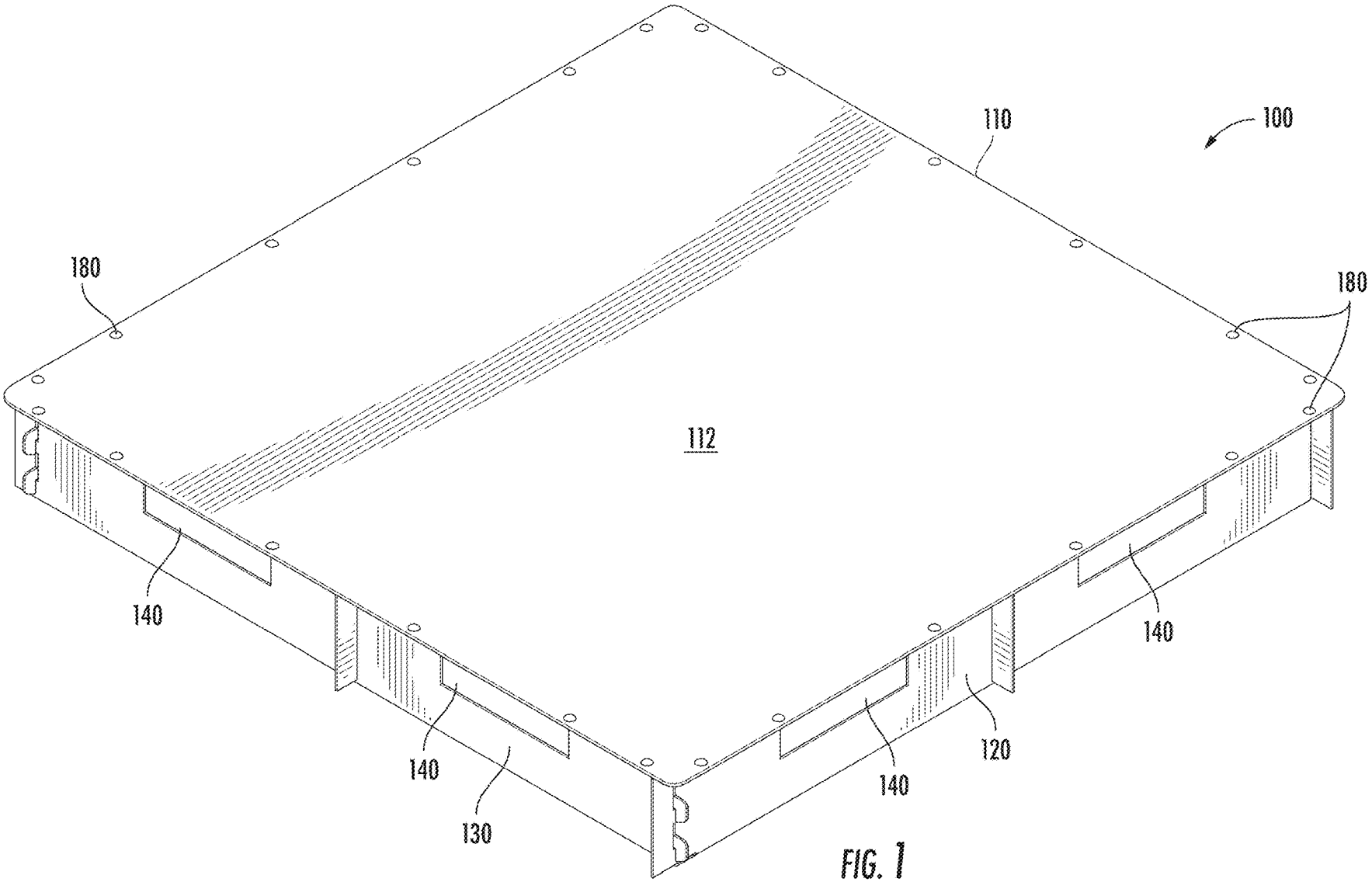
FIG. 1 illustrates a top perspective view of an example weldless, interlocking pallet in an assembled configuration accordance with some embodiments.

The present disclosure now will be described more fully hereinafter with reference to the accompanying drawings, in which some, but not all aspects are shown. Indeed, the disclosure may be embodied in many different forms and should not be construed as limited to the aspects set forth herein. Rather, these aspects are provided so that this disclosure will satisfy applicable legal requirements. Like numbers refer to like elements throughout.

Pallets, also referred to as skids, as described herein are flat structures used to support goods for transport. Pallets are used in a wide array of industries and provide a relatively common form factor that is adapted for efficient transport. Pallets are used for transporting goods locally around a business location (e.g., within a manufacturing plant) and between locations, such as being carried by truck, shipping container, or the like. Pallets are adapted for transport using forked transport means, such as pallet jacks, forklifts, or the like. These transport means engage pallets through a somewhat standardized interface with the pallets that permit forks of the pallet jacks or forklifts to be received under or through the pallet at a base of the pallet in order to lift and move the pallet and the goods supported thereon.

Pallets are ubiquitous in the transport of goods. The most common material used for pallets is wood as wooden pallets are relatively inexpensive and can be disposable after one or more uses. Wooden pallets are well-suited to the transport of many types of goods. However, wooden pallets often have limited carrying capacities, and can deteriorate over time through exposure to environmental factors along with repeated lift-and-move cycles. Wooden pallets carrying heavy articles are also more prone to degradation. Reusable pallets or pallets designed for longer life are generally made from more robust materials, such as plastics, composites, metal, or combinations thereof. Embodiments described herein can similarly be made from a variety of materials.

An example pallet of the present disclosure may include a plurality of interlocking support structures in the form of interconnected side members configured to form the perimeter of the pallet (e.g., to surround a bounded interior space) which is generally a rectangular, and sometimes a square base to the pallet. These support structures may each, for example, define a plurality of slots on a first end and a plurality of corresponding engagement features (e.g., hooks, flanges, etc.) on a second end opposite the first end. In this way, the plurality of support structures may be configured to be sequentially attached to one another (e.g., via an engagement feature disposed within a corresponding slot) to form the perimeter of the pallet. By way of a non-limiting example, four (4) support structures or side members may be attached via engagement between respective first and second ends to form a rectangular perimeter. In some embodiments, a pair of intersecting support members may be attached to the above-described plurality of support structures so as to provide an interlocking configuration of elements that span the interior defined by the perimeter of support structures.

The interlocking nature of these support members and structures allows for ease of assembly of the example pallet after transportation to the end location. Furthermore, the embodiments described herein may include a top member or support plate that is, following engagement between the interlocking support structures/members, fastened to the network of interlocking support structures so as to provide an exterior surface on which objects may be placed. In a nonlimiting example embodiment described herein, a coil of wire may be supported by a top surface of the top support plate. This configuration may further allow for a forklift or equivalent device to engage the pallet design by placing forks, tines, etc. on a bottom surface (e.g., opposite the top surface) of the top support plate. In this way, the embodiments described herein allow for the modular components of the pallet to be shipped to an end location prior to assembly so as to reduce the burden and cost associated with conventional pallet designs without compromising the structural integrity of the pallet.

In some embodiments, the top member support plate may be further configured to support cylindrical objects thereon in a horizontal position or orientation using load stabilizing features as described herein. By way of example, the top surface of the top member support plate may include one or more contours, groove, ridges, channels, etc. within which a cylindrical coil of wire may be placed in a horizontal position. In other words, the contours, grooves, ridges channels, etc. of the top surface of the top support plate may operate to prevent a cylindrical coil of wire from rolling off of the top support plate. In some embodiments, the features (e.g., contours, ridges, grooves, channels, etc.) configured to prevent this unintended movement of the cylindrical coil of wire may be formed integral to the top support plate (e.g., formed during manufacture of the top support plate). In other embodiments, the features (e.g., contours, ridges, grooves, channels, etc.) configured to prevent this unintended movement of the cylindrical coil of wire may be removably attached to the top surface of the top support plate (e.g., via one or more fasteners, bolts, etc.).

Embodiments of the present disclosure include pallets that are reusable and not subject to the typical wear and degradation of a conventional wooden pallet. Further, embodiments described herein do not require welding or bonding of materials to form a strong, high-capacity pallet. Pallets described herein can be fabricated with fasteners and can include replaceable elements should one or more parts of the pallet be damaged. FIG. 1 illustrates an example embodiment of a pallet 100 as described herein. The pallet 100 of FIG. 1 includes a top member 110 that forms a load-carrying top surface 112. The pallet 100 of FIG. 1 further includes a first side member 120 and second side member 130, while a third side member (not visible) is positioned opposite of the first side member, and a fourth side member (not visible) is positioned opposite of the second side member.

According to the illustrated embodiment of FIG. 1, the first side member 120 and the second side member 130 each include apertures 140 through which forks are received for lifting and moving the pallet 100 and goods supported thereon. The apertures 140 of the illustrated embodiment are elevated from a bottom of the pallet which is suitable for transport using a forklift. However, the apertures of some embodiments can include apertures at a bottom of the side member such that a pallet jack can be received through the apertures.

Figure 2:
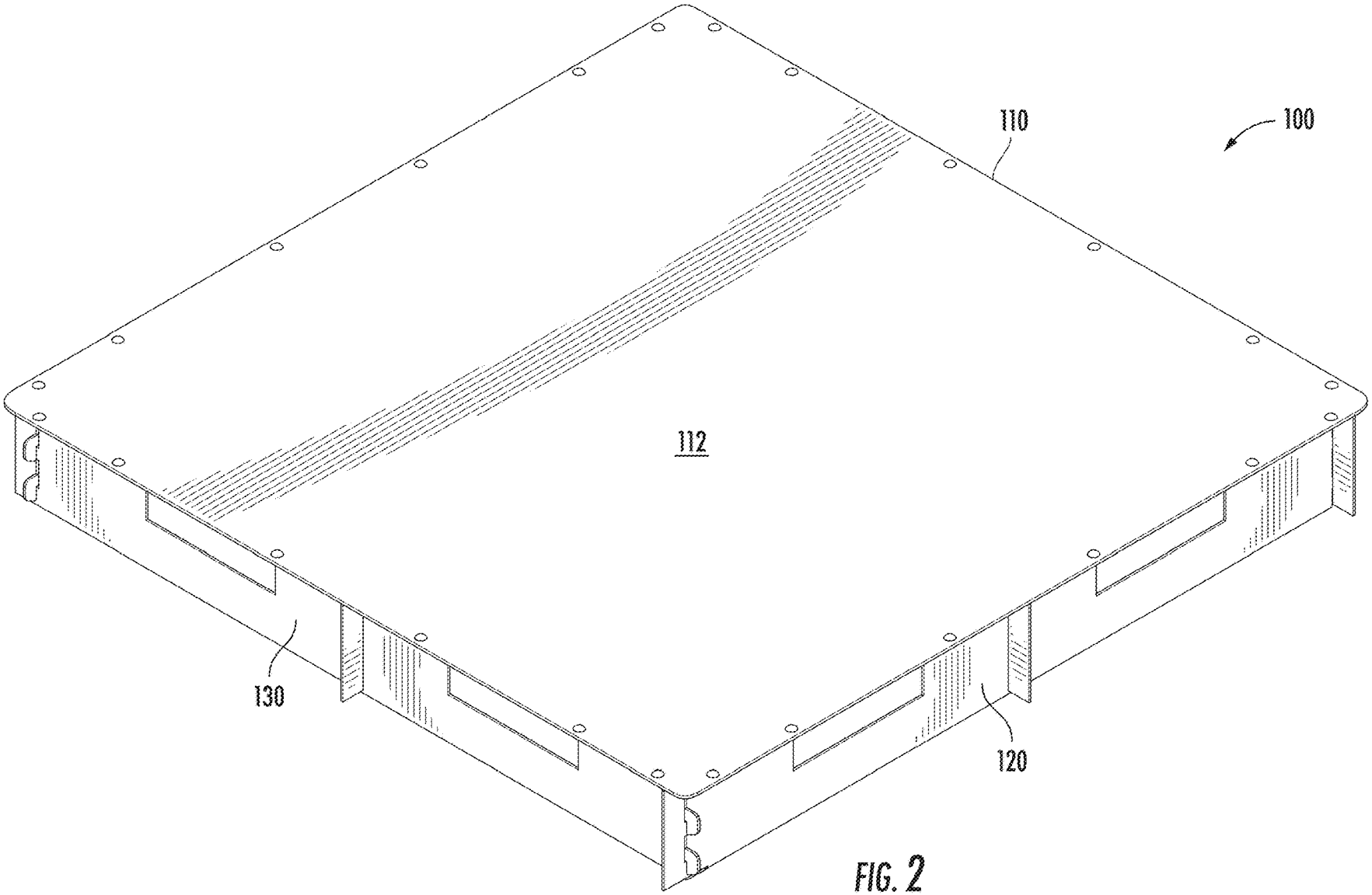
FIG. 2 illustrates another top perspective view of the assembled weldless, interlocking pallet of FIG. 1 in accordance with some embodiments.
Figure 3:
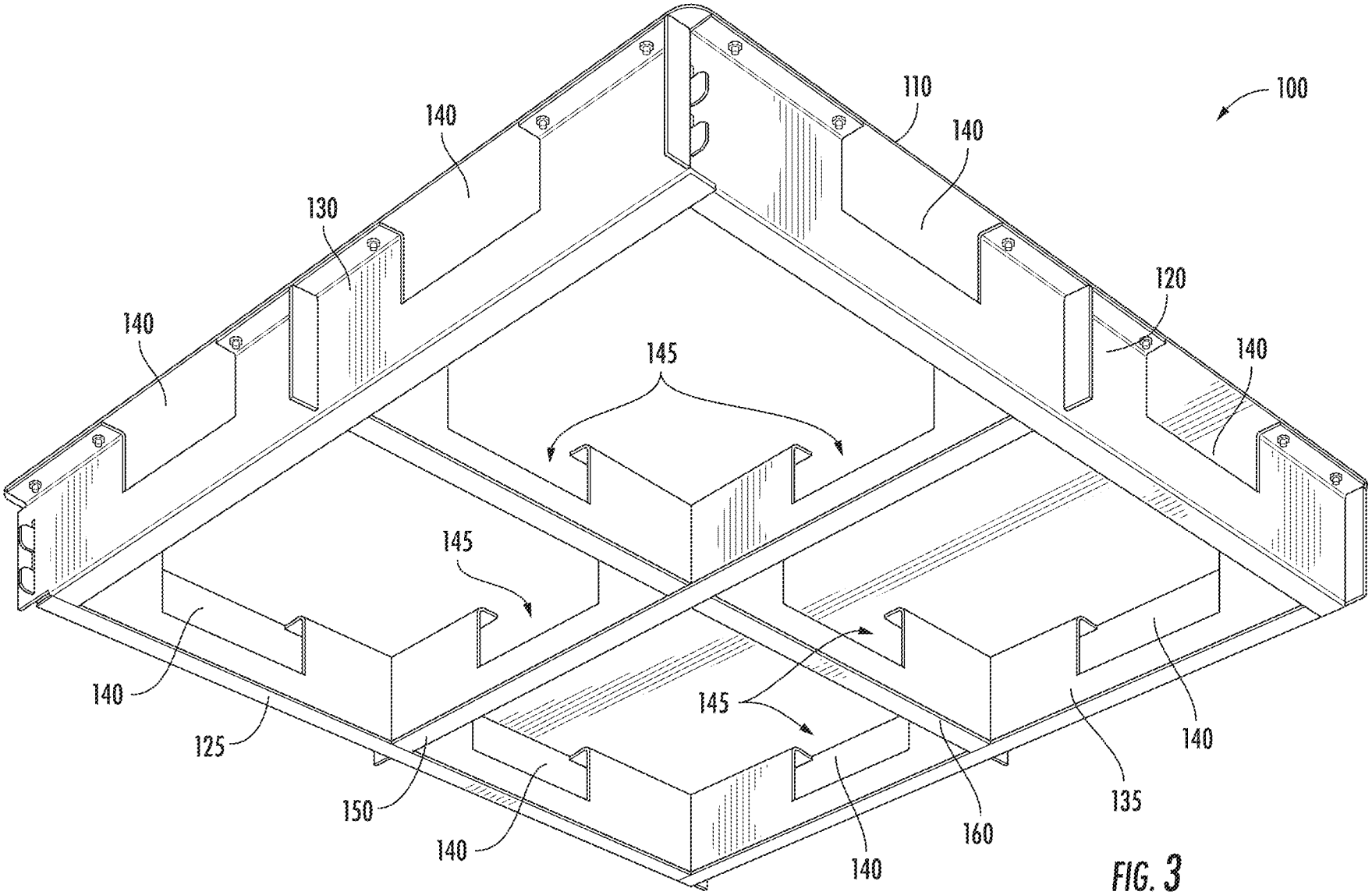
FIG. 3 illustrates a bottom perspective view of the assembled weldless, interlocking pallet of FIG. 1 in accordance with some embodiments.

FIG. 2 illustrates another view of the pallet 100 illustrated in FIG. 1 including the top member 110, first side member 120, and second side member 130. FIG. 3 illustrates a view of a bottom side of the pallet 100 of FIGS. 1 and 2. Visible in FIG. 3 are the first side member 120, second side member 130, third side member 125, and fourth side member 135. Also visible is a first support member 150 and a second support member 160. The first support member 150 extends between the first side member 120 and the third side member 125, while the second support member 160 extends between the second side member 130 and the fourth side member 135. The first support member 150 and second support member 160 each include apertures 145 there through that substantially align with the apertures 140 in the sides of the pallet 100. The apertures 145 through the first and second support allow forks entering through apertures 140 in the sides to pass through the supports, thereby enabling a forklift (or pallet jack) to fully support the pallet 100 with the forks of the forklift.

According to the illustrated embodiment of FIGS. 1 through 3 include apertures 140 through the side members just beneath the top member 110, forks received through the apertures to lift the pallet will lift directly against an underside of the top member, thereby supporting a weight of any goods on the pallet directly onto the forks by way of the top member. In an example embodiment in which the apertures are not immediately below the top member 110, the forks will engage the side members and the supports in lifting the pallet. In such an embodiment, the apertures may include a reinforcing flange to strengthen a surface of the side member or support against which the forks are lifting. Such a flange may be in the form of a portion of the side member or support bent at the aperture to create a 90-degree bend that will strengthen the aperture and be resistant to bending of the side member or support in a direction parallel to the top surface 112, as forks of a forklift or pallet jack that are not properly aligned with the apertures could strike the side member or supports.

Figure 4:
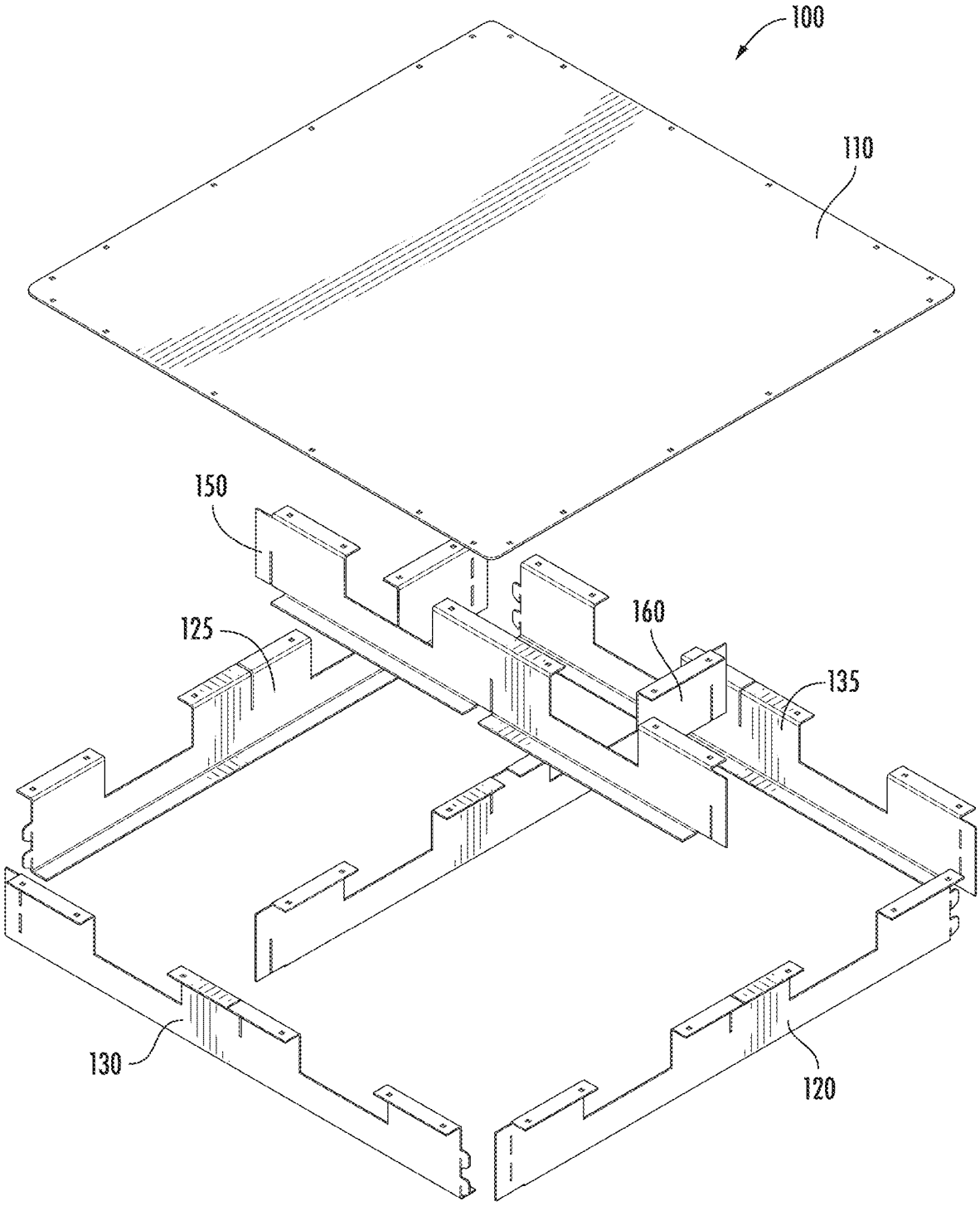
FIG. 4 illustrates an exploded view of the example weldless, interlocking pallet of FIG. 1 in accordance with some embodiments.
Figure 5:
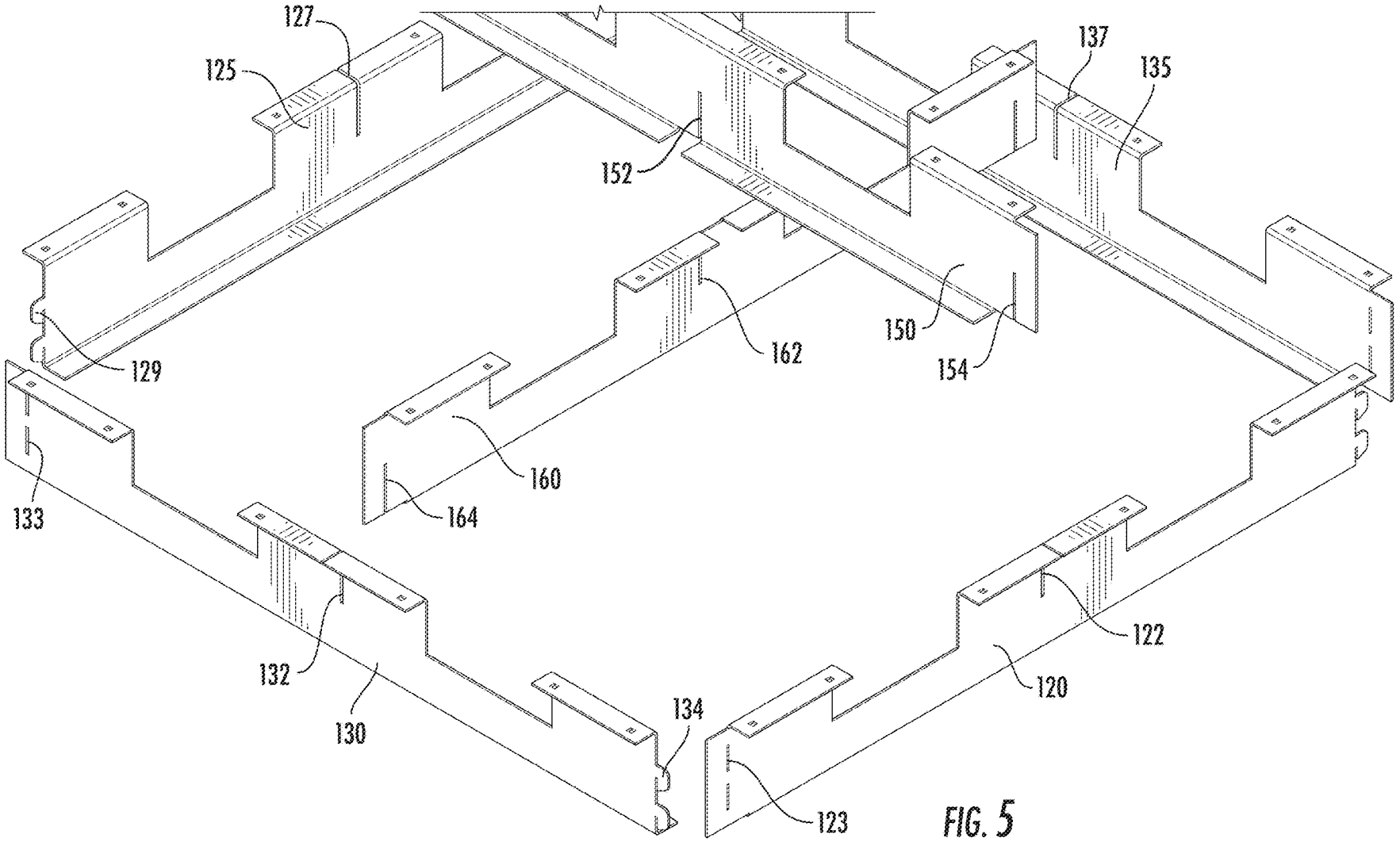
FIG. 5 illustrates a portion of the exploded view of FIG. 4 showing the interlocking support members of the example weldless, interlocking pallet in accordance with some embodiments.

FIG. 4 is an exploded view of the pallet 100 of FIGS. 1 through 3 illustrating the manner in which the components of the pallet 100 are joined together without welds or adhesive to form the pallet. As illustrated, the pallet includes the first side member 120, second side member 130, third side member 125, and fourth side member 135. Further included are the first support member 150 and the second support member 160, along with the top member 110. FIG. 5 illustrates an enlarged exploded view similar to that of FIG. 4 depicting greater detail of the elements for joining the components.

As illustrated in FIG. 5, the first side member 120 includes slots 123 while the second side member 130 includes tabs 134. The tabs 134 of the second side member 130 are received into the slots 123 of the first side member to join the first side member to the second side member. The second side member 130 also includes slots 133 into which tabs 129 of the third side member 125 are received to join the second side to the third side member. The fourth side member 135 is similarly joined between the first side member and the third side member. Each of the first side member 120, second side member 130, third side member 125, and fourth side member 135 may be identical and therefore interchangeable to reduce complexity and increase the ease of assembly.

The first side member 120, second side member 130, third side member 125, and fourth side member 135 of the illustrated embodiment each have slots defined therein to receive the first or second support member. As shown, the first side member 120 includes slot 122, while the first support member 150 includes slot 154. The slot 122 of the first side member 120 receives an end of the first support member 150 including slot 154. The complementary slots enable full engagement between the first support member 150 and the first side member 120. The third side member 125 similarly includes a slot 127 into which an opposite end of the first support member 150 is received having a complementary slot. The first support member 150 also includes slot 152 proximate a middle of the first support member, while the second support member 160 includes slot 162 proximate a middle of the second support member. These slots are complementary such that the first support member 150 can fully engage the second support member 160 and form a cross-bracing support. In this manner, the first side member 120, second side member 130, third side member 125, and fourth side member 135 along with the first support member 150 and the second support member 160 can be assembled together without any fasteners, welding, or bonding.

Figure 6:
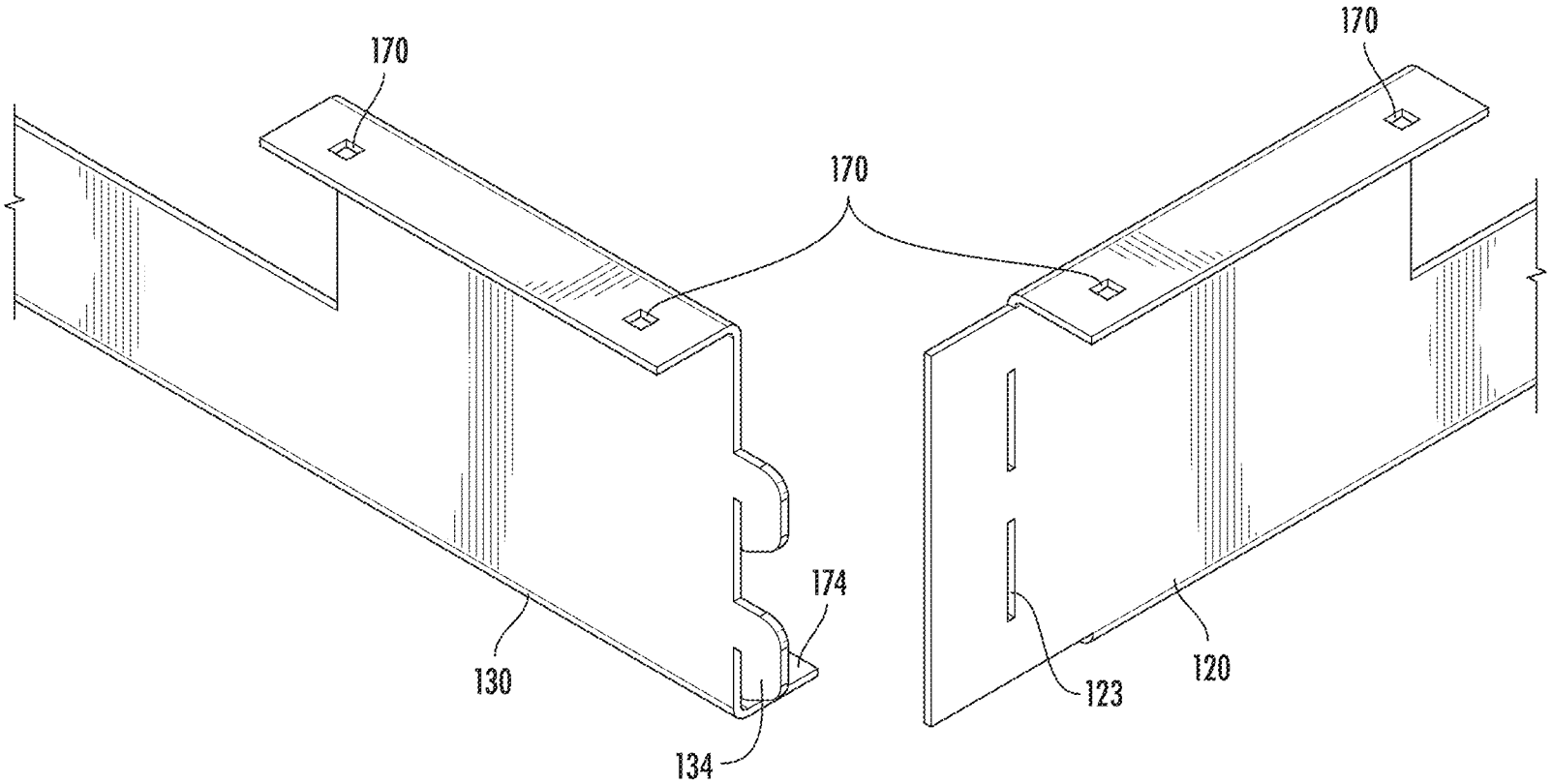
FIG. 6 illustrates a portion of the example interlocking support members prior to assembly in accordance with some embodiments.

FIG. 6 illustrates a greater detail view of the first side member 120 with slots 123 and the second side member 130 with the tabs 134. The tabs 134 of the illustrated embodiment are hook-shaped, such that upon being received into the slots 123, the tabs are driven downward (relative to the top member 110) which locks the first side member 120 to the second side member 130. Each corner of the pallet is similarly assembled and similarly locked together. Also illustrated in FIG. 6 are fastener holes 170 formed in a top flange 172 of the first side member 120 and a top flange 172 of the second side member 130. Also illustrated is a bottom flange 174 of the second side member 130. The top flanges 172 and bottom flanges 174 which are found on each side of the pallet provide added rigidity to the side members and aid in stiffening of each side member. The flanges further resist bending of the side members which may otherwise occur when forks of a forklift or pallet jack are not properly aligned with the apertures in the side members.

Referring back to FIG. 1, the top member 110 includes fastener holes that align with fastener holes 170 of the first side member 120, second side member 130, third side member 125, and fourth side member 135 of the pallet base when the pallet sides are assembled. Fasteners 180 shown in FIG. 2 are received into the fastener holes of the top member and through the fastener holes 170 of the side members. Various fastening methods may be employed, such as fastener holes 170 that are threaded and receive therein a corresponding threaded fastener which can be secured to the fastener hole, pinching the top member between the fastener and a respective side member. Optionally, a bolt can be received through the fastener hole of the top member and through a corresponding fastener hole 170 of a respective side member, and a nut secured to the bolt to pinch the top member 110 and the top flange 172 of a respective side member therebetween. In some embodiments, such as the embodiment depicted in FIG. 6, the fastener holes 170 can be square, and the fastener can be a carriage bolt. Carriage bolts have a square shank just beneath the head, such that when inserted into a correspondingly sized square hole, the carriage bolt does not rotate. In this way, a nut can be affixed to the carriage bolt without needing to separately hold or turn the bolt. Further, carriage bolts have low-profile domed heads, such that they have minimal protrusion above the top surface 112 of the top member 110. In some embodiments, the top member 110 may include recesses around the fastener holes to further reduce protrusion of bolt heads above the top surface 112.

Pallets according to embodiments of the present disclosure can be assembled without requiring any welds or bonding of materials. The top member 110 can be affixed to the side members of the pallet through a variety of fastening mechanisms, and can employ welding or bonding in lieu of fasteners if so desired. However, the use of fasteners as described above enables quick assembly of a pallet with only a single tool (e.g., a ratchet and socket or wrench), and permits disassembly and replacement of components with such a single tool. The interlocking tabs and slots join the side members of the pallet together with the support members, and affixing the top member to the side members serves to lock the side members together with one another, as the affixed top member prevents the movement between the sides and support members that would be required to separate them.

The top member 110 can be made from variety of materials, such as metal, composite, reinforced plastic, or the like provided that the top member is sufficiently rigid to not deflect substantially under load. The first side member 120, the second side member 130, the third side member 125, and the fourth side member 135 can similarly be made from a variety of materials; however, the materials should be sufficiently rigid to support a predetermined load based on an intended use of the pallet. The first support member 150 and second support member 160 can similarly be of a variety of materials provided they are sufficiently rigid. In an example embodiment, the top member 110, the side members, and the support members are formed of metal, such as steel, which may be between 1/16- and 1/4-inches in thickness or between about 16- and 3-gauge steel. In such an embodiment, the load capacity for a pallet of the present design can be very high, such that loads can be supported beyond the capacity of most other pallet designs and materials. The different components can employ different materials and different thicknesses based on the anticipated load that the pallet will carry.

Figure 7:
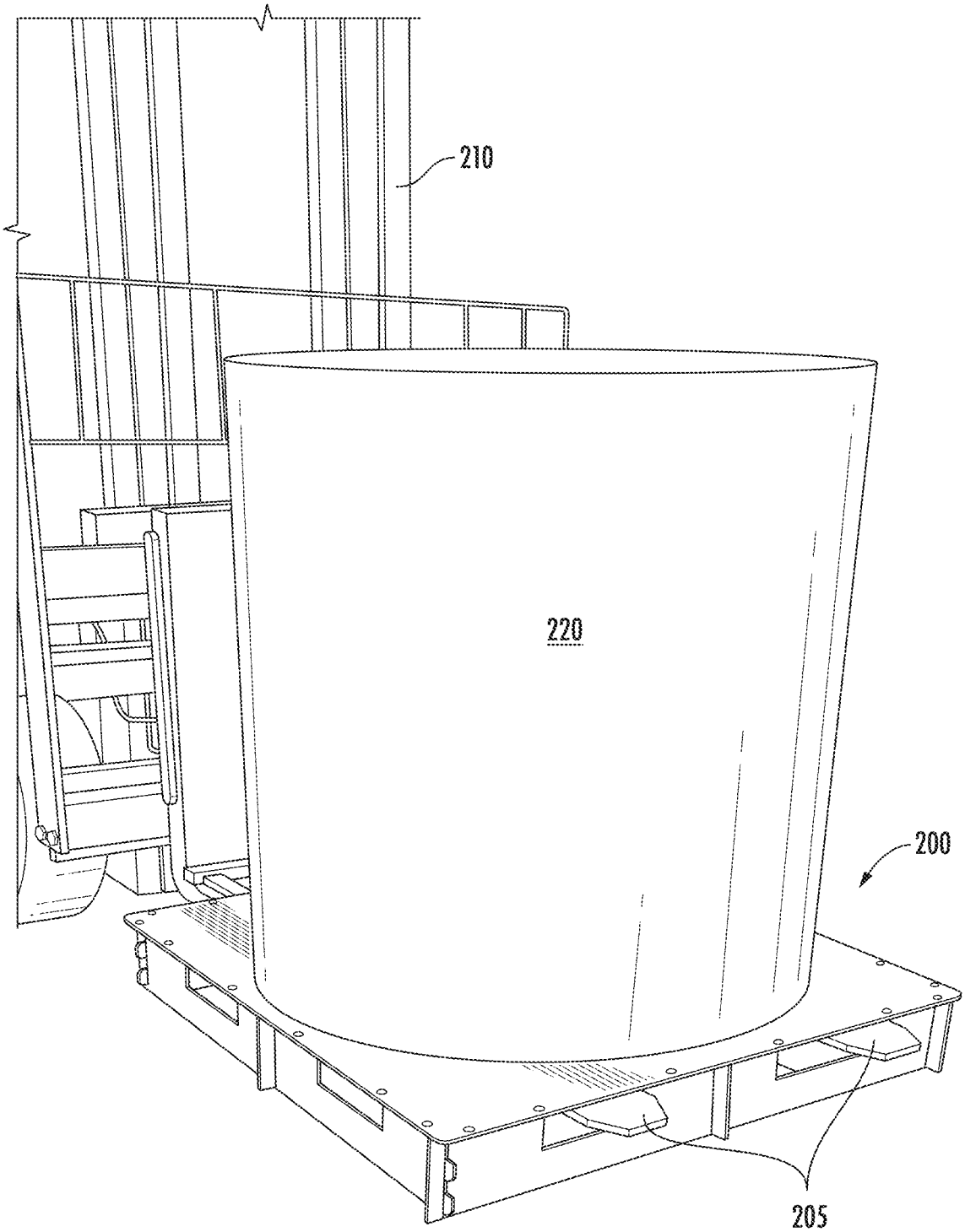
FIG. 7 depicts an example weldless, interlocking pallet in an operational configuration supporting a coil of wire in accordance with some embodiments.

FIG. 7 illustrates an example embodiment of a pallet 200 of the present disclosure as carried by the forks 205 of a forklift 210. The illustrated embodiment depicts a coil of metal wire 220 as the load supported by the pallet 200. Coils of metal (e.g., sheet metal, metal wire, etc.) can be exceedingly heavy and standard pallets cannot support such weights, such that embodiments of the pallets described herein provide a durable pallet capable of carrying substantial weights. Coils of sheet metal are also an example of a type of product that is difficult to manipulate and transport given their substantial weight and their lack of features conducive to grasping and lifting. As such, a pallet as described herein is a substantial benefit to transporting such awkward and heavy objects, as the pallet provides a uniform engagement method for standard forklifts and pallet jacks that can more readily engage and lift the pallet carrying the awkward, heavy objects. Beyond coils of sheet metal, embodiments of the pallets described herein can carry a variety of challenging loads. For example, boulders, large rocks, metal or stone sculptures, and barrels are some examples of loads that can be difficult to maneuver and transport. However, the pallets as described herein can carry such loads and provide means for engaging and lifting such loads with relative ease.

Figure 8:
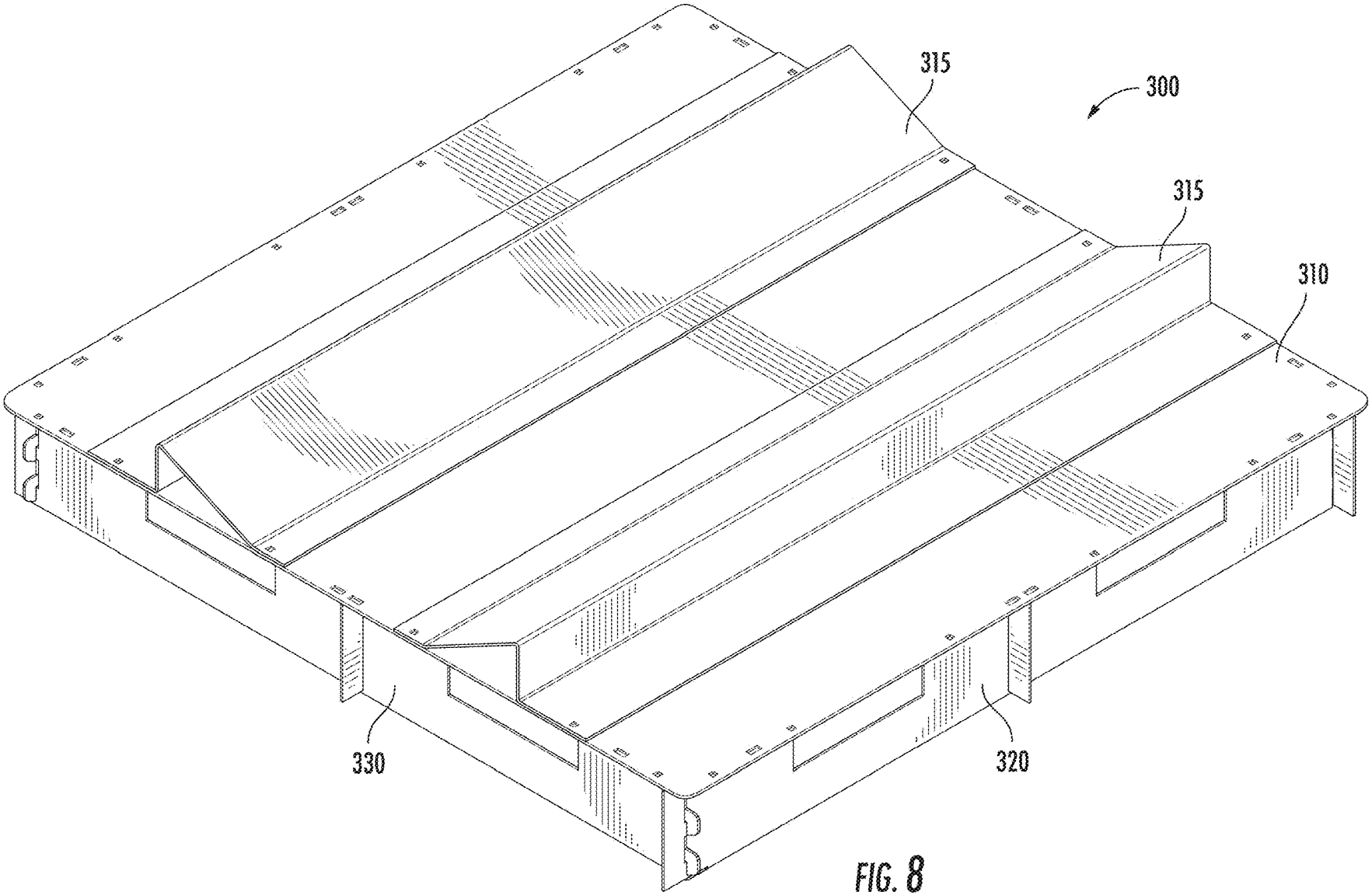
FIG. 8 illustrates another weldless, interlocking pallet design in an assembled configuration for use with horizontally oriented cylindrical objects in accordance with some embodiments.

The interchangeable nature of the components of pallets as described herein provides additional benefits in the form of customizable components that can be used to adapt the pallet to specific use cases. According to an example embodiment, the top member of a pallet can be replaceable with top members having different form factors and adapted to better handle specific types of loads. FIG. 8 illustrates one such example embodiment of a pallet 300 configured to carry a specific load form factor. According to the illustrated embodiment of FIG. 8, the pallet 300 includes the top member 310 along with a first side member 320 and second side member 330, with the third and fourth sides not visible in the view provided. The top member 310 of the pallet 300 of FIG. 8 further includes load stabilizing features 315 in the form of opposing wedges. The embodiment of FIG. 8 may be well-suited to carry a spool of material that has a round form factor, with the cylindrical shape of the spool cradled between the load stabilizing features 315. These load stabilizing features 315 can maintain the spool on the pallet 300 and preclude the spool from rolling off of the pallet. Various other load stabilizing features may be employed depending upon the type of load to be carried by the pallet. For example, a top member of a pallet may include a raised lip about the perimeter, or sides about the perimeter to hold loose articles as the load. Some pallet-carried loads include bagged materials, such as smaller rocks, fill dirt, sand, etc. which may be supported by a pallet, but may have a tendency to slide on a pallet. Walls or a lip about a perimeter or along a portion of a perimeter of the top member can preclude this tendency and stabilize the load on the pallet.

While the embodiment of FIG. 8 is described with respect to interchangeable top members for different load form factors, embodiments can employ a uniform top member, while allowing load stabilizing features to be secured to the pallet, such as using fastener holes, such as the fastener holes 170 of FIG. 6. In this way, the load stabilizing features, such as those shown in FIG. 8, can be attached to the pallet on top of the top member of the pallet. Such removable and replaceable load stabilizing features would retain a common form factor for the pallet, while allowing customizable load carrying abilities of individual pallets.

Figure 9:
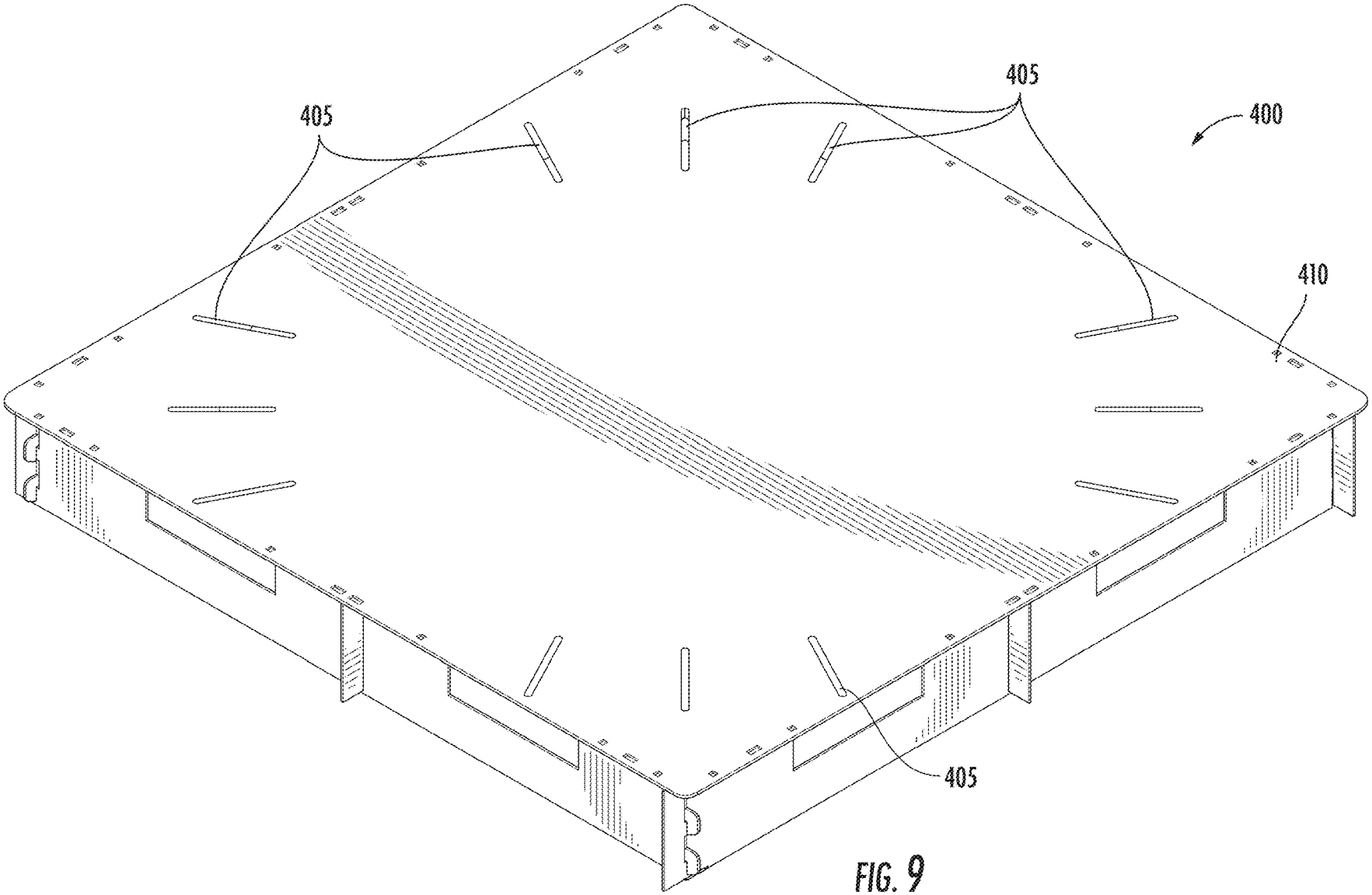
FIG. 9 illustrates another weldless, interlocking pallet design in an assembled configuration for use with various attachments in accordance with an example embodiment of the present disclosure.

FIG. 9 illustrates another example embodiment of a top member 410 of a pallet 400 that is configured for facilitating securing of a load to the pallet. As shown, the top member 410 includes attachment features 405 in the form of slots within the top member. The attachment features 405 of the illustrated embodiment of FIG. 9 extend radially from a center of the top member. The slots may receive therein fasteners to fasten load stabilizing features that secure a load to the pallet. The slots may, in some embodiments, be reinforced such that forces exerted on the fasteners received through the slots do not deform the slots or pull through the slots. The reinforcement may depend upon the load to be carried by the pallet and the anticipated forces, both static and dynamic, received at the fasteners. The attachment features 405 of the illustrated embodiment are radially-extensive slots; however, attachment features may take a variety of forms. Slots can be beneficial as they can receive therein fasteners, such as carriage bolts, from below the top member 410, while the width of the slot can hold the carriage bolt and prevent the carriage bolt from spinning while a nut is affixed to the carriage bolt.

Other embodiments of attachment features may be employed based upon a load to be carried by the pallet. The attachment features may include pairs of slots, where tie-down straps can be fed through the pairs of slots and secured over a load carried on the pallet. Other attachment features may include slots formed for engagement by tie-down hooks, such as radially extending slots that can receive therein a tie-down hook that, when secured, is turned 90-degrees relative to the slot to be secured within the slot and tensioned to secure the load. Other attachment features may include threaded inserts, such as rivet nuts, that may be received within the top member 410 and used to receive fasteners therein. The attachment features can be sized and positioned on the top member to accommodate a specific load form factor. Optionally, the attachment features can be distributed on the top member suitable for securing a variety of loads with a variety of types of fasteners and/or straps.

Figure 10:
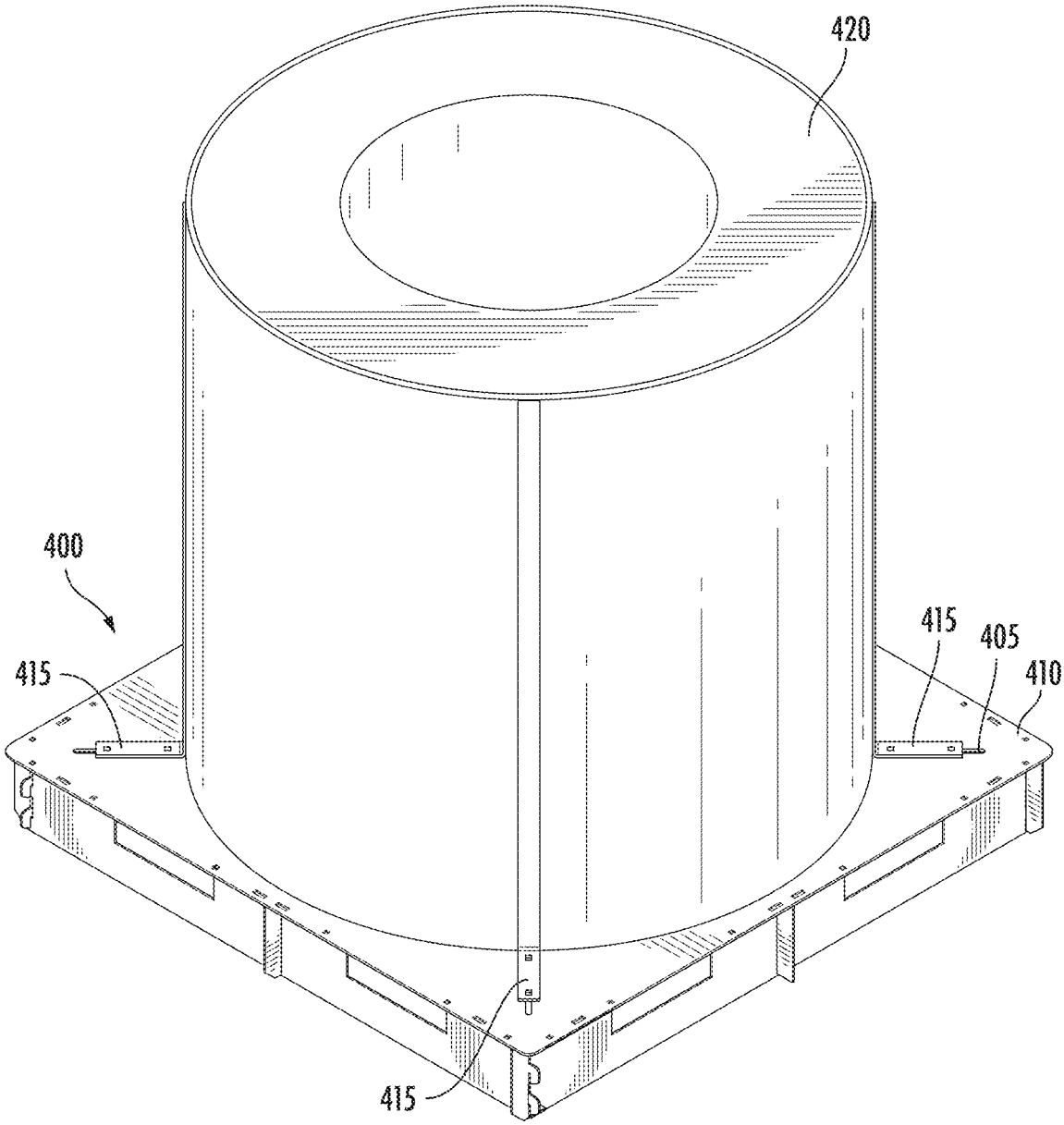
FIG. 10 illustrates the weldless, interlocking pallet design of FIG. 8 including attachments used to secure a load according to an example embodiment of the present disclosure.

FIG. 10 illustrates an example embodiment of the pallet 400 of FIG. 9 having a load in the form of a coil of metal wire 420 secured thereon. The coil of metal wire 420 is secured to the pallet 400 by load stabilizing features 415 in the form of uprights. The uprights, secured to the slots as attachment features 405. The uprights can be moved toward and away from a center of the top member 410 as the uprights are secured into slots that enable movement, thereby enabling the uprights to adapt to a variety of diameters of coils. To further secure the coil of metal wire 420 on the pallet 400, the load stabilizing features 415 may be strapped to the coil of metal wire 420, which more positively secures the coil to the pallet and reduces a likelihood of the coil tipping during movement.

A variety of load stabilizing features may be implemented together with a variety of attachment features to secure the load stabilizing features to the top member of the pallet. These load stabilizing features and attachment features can be made specifically for a particular use case, such as used for the coil of metal wire as illustrated in FIGS. 8 and 10, or structured to be adaptable to a variety of different form factors and sizes. Thus, the pallets of embodiments described herein are cost effective and efficient. As the weldless metal pallets described herein are very durable relative to conventional pallets, the repeated use of the pallets described herein provide an opportunity and justification to incorporate additional features, such as the load stabilizing features, which may be cost prohibitive on pallets having lower durability and shorter life spans. Thus, it is not apparent to modify pallets in such a way as to include the load stabilizing features and attachment features of the present disclosure in conventional pallet applications.

Many modifications and other embodiments of the inventions set forth herein will come to mind to one skilled in the art having the benefit of the teachings presented in the foregoing descriptions and the associated drawings. Therefore, it is to be understood that the present application is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A load carrying structure comprising:

a plurality of side members comprising a first pair of side members and a second pair of side members removably connected to each other to form a base as a quadrilateral shape;

a first support member and a second support member, wherein the first support member is removably connected between the first pair of side members and extends through the quadrilateral shape, and the second support member is removably connected between a the second pair of side members and extends through the quadrilateral shape;

a top member, wherein the top member is removably fastened to each of the plurality of side members, wherein a pair of apertures is defined in each of the plurality of side members each of the pair of apertures is bounded on one side by the top member, wherein each of the pair of apertures is sized and configured for receiving forks of at least one of a forklift or a pallet jack.

2. The load carrying structure of claim 1, wherein each of the plurality of side members are identical.

3. The load carrying structure of claim 1, wherein the plurality of side members each define a top side and a bottom side, wherein the plurality of side members are connected to each other using a tab and a slot, wherein a respective tab is received within a respective slot and secured through a relatively downward movement of the tab toward the bottom side of a respective side member.

4. The load carrying structure of claim 3, wherein the top member, fastened to each of the plurality of side members, precludes disengagement of the respective tab from the respective slot.

5. The load carrying structure of claim 1, wherein the first support member and the second support member are removably connected to each other.

6. The load carrying structure of claim 1, wherein the top member, when fastened to each of the plurality of side members, prevents disconnection between the plurality of side members, the first support member, and the second support member.

7. The load carrying structure of claim 1, wherein the top member defines a top surface, wherein the top surface comprises at least one load stabilizing feature.

8. The load carrying structure of claim 7, wherein the at least one load stabilizing feature comprises a pair of opposing wedges configured to cradle a load therebetween.

9. The load carrying structure of claim 1, wherein the first support member interlocks with the second support member, wherein a first pair of apertures is defined in the first support member bounded on one side by the top member, wherein a second pair of apertures is defined in the second support member bounded on one side by the top member.

10. The load carrying structure of claim 1, wherein each of the plurality of side members comprise a top flange and a bottom flange, wherein the top flange is fastened to the top member by fasteners, and wherein the bottom flange supports the load carrying structure on a surface.

11. The load carrying structure of claim 1, wherein the plurality of side members, the first support member, the second support member, and the top member are each formed of metal, and wherein the plurality of side members, the first support member, and the second support member are between 3-gauge and 16-gauge thick steel.

12. The load carrying structure of claim 11, wherein the load carrying structure can be assembled without welding or bonding.

13. A load carrying structure comprising:

a first side member, a second side member, a third side member, and a fourth side member, wherein the first side member, the second side member, the third side member, and the fourth side member are releasably connected to form a rectangular base;

a first support member removably connected between the first side member and the third side member within the rectangular base;

a second support member removably connected between the second side member and the fourth side member within the rectangular base; and a top member removably connected to the first side member, the second side member, the third side member, and the fourth side member, wherein the first side member, the second side member, the third side member, the fourth side member, the first support member, and the second support member are precluded from disconnecting from one another in response to the top member being connected to the first side member, the second side member, the third side member, and the fourth side member, and wherein each if the first side member, the second side member, the third side member, the fourth side member, the first support member, and the second support member define a pair of apertures, wherein each pair of apertures is bounded on one side by the top member, wherein each of the pair of apertures is sized and configured for receiving forks of at least one of a forklift or a pallet jack.

14. The load carrying structure of claim 13, wherein each of the first side member, the second side member, the third side member, and the fourth side member are all interchangeable with one another.

15. The load carrying structure of claim 13, wherein each of the first side member, the second side member, the third side member, the fourth side member, the first support member, and the second support member are formed from sheet metal.

16. The load carrying structure of claim 13, wherein the first side member, the second side member, the third side member, and the fourth side member are releasably connected by complementary pairs of tabs and slots to form the rectangular base.

17. The load carrying structure of claim 13, wherein the top member defines a top surface, wherein the top surface comprises at least one load stabilizing feature.

18. A method of constructing a load carrying structure comprising:

interconnecting a first side member, a second side member, a third side member, and a fourth side member to form a rectangular base;

connecting a first support member between the first side member and the third side member within the rectangular base;

connecting a second support member between the second side member and the fourth side member within the rectangular base; and connecting a top member to the first side member, the second side member, the third side member, and the fourth side member, wherein the first side member, the second side member, the third side member, the fourth side member, the first support member, and the second support member are locked together by the top member, and wherein each if the first side member, the second side member, the third side member, the fourth side member, the first support member, and the second support member define a pair of apertures, wherein each pair of apertures is bounded on one side by the top member, wherein each of the pair of apertures is sized and configured for receiving forks of at least one of a forklift or a pallet jack.

19. The method of claim 18, wherein connecting the top member to the first side member, the second side member, the third side member, and the fourth side member comprises fastening the top member to the first side member, the second side member, the third side member, and the fourth side member using a plurality of threaded fasteners.

20. The method of claim 18, wherein interconnecting the first side member, the second side member, the third side member, and the fourth side member to form the rectangular base comprises joining tabs and slots of respective side members at each corner of the rectangular base.

* * * * *